United States Patent [19]

Gardner

[11] 4,096,984

[45] Jun. 27, 1978

[54] INTERNAL PARTITION ARRANGEMENT

[75] Inventor: Jeffrey M. Gardner, Wheaton, Ill.

[73] Assignee: Container Corporation of America, Chicago, Ill.

[21] Appl. No.: 861,879

[22] Filed: Dec. 19, 1977

[51] Int. Cl.[2] ..... B65D 5/48; B65D 25/04

[52] U.S. Cl. ..... 229/15; 229/42

[58] Field of Search ..... 229/15, 28, 42; 217/31, 217/32

[56] References Cited

U.S. PATENT DOCUMENTS

| | | | |
|---|---|---|---|
| 2,830,749 | 4/1958 | Lauritzen | 229/15 |
| 2,844,294 | 7/1958 | Williams | 229/15 X |
| 3,640,445 | 2/1972 | Durham | 229/15 |
| 3,738,561 | 6/1973 | Mederueld | 229/15 |
| 3,743,163 | 7/1973 | Helns | 229/15 |
| 3,963,169 | 6/1976 | Gardner | 229/28 R |
| 4,030,659 | 6/1977 | Gardner | 229/15 |

*Primary Examiner*—Davis T. Moorhead

*Attorney, Agent, or Firm*—Carpenter & Ostis

[57] ABSTRACT

An internal partition formed of a unitary blank of paperboard for providing a plurality of cells within an outer package.

2 Claims, 5 Drawing Figures

INTERNAL PARTITION ARRANGEMENT

SUMMARY OF THE INVENTION

This invention relates to an internal partition and more particularly to a one-piece partition formed of paperboard and adapted to provide a plurality of cells within a package.

The partition is adapted for use within a conventional paperboard shipping container, a film wrapped tray, or within a film wrapper. The present invention provides an improved one-piece partition structure which offers increased compressive strength over conventional two-piece partitions heretofore used for this purpose.

It is an object of this invention therefor, to provide an improved one-piece partition formed of paperboard which forms into a divider having a central quadrilateral shape surrounded by groups of triangular shaped cells. These and other objects of the invention will be apparent from an examination of the following description and drawings.

THE DRAWINGS

It will be understood that, for purposes of clarity, certain elements may have been intentionally omitted from certain views where they are believed to be illustrated to better advantage in other views.

THE DESCRIPTION

Figure 1:
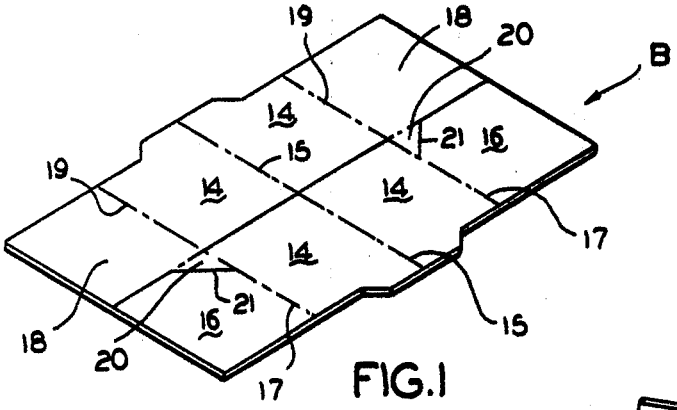
FIG. 1 is a plan view of the blank from which the partition illustrated in the other views may be formed.
Figure 4:
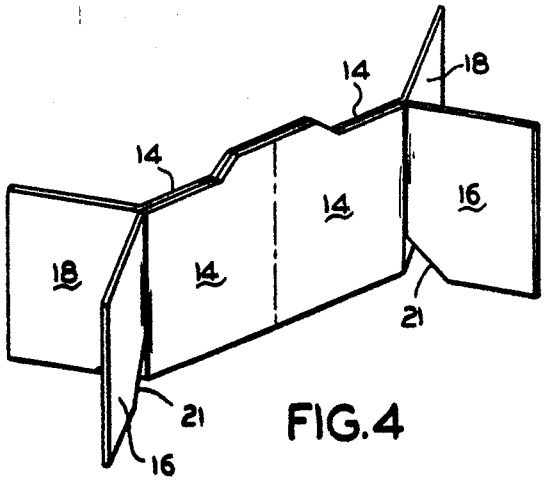
FIGS. 2, 3 and 4 are perspective views illustrating the manner in which the partition is erected.

Referring now to the drawings for a better understanding of the invention, it will be seen that the novel partition indicated generally at P may be formed from a unitary blank B of foldable paperboard as illustrated in FIG. 1.

The partition includes a pair of generally similar first and second panel sections indicated generally at 10 and 12, respectively, each of which includes four partition panels.

Each of the panel sections includes a pair of intermediate panels 14 which are foldably joined to each other along a common fold line 15 but which are free from attachment to the corresponding intermediate panels of the other panel section.

Each of the panel sections also includes a pair of end panels disposed outboardly of the related intermediate panels. First panel section 10 includes end panels 16 which are foldably joined at their inboard edges along fold lines 17 to the outboard edges of related intermediate panels 14. Second panel section 12 includes end panels 18 which are foldably joined at their inboard edges along fold lines 19 to the outboard edges of related intermediate panels 14. It will be noted that the end panels of each panel section are also free from direct attachment to the corresponding end panels of the other panel section. The sole means of connection between the two panel sections comprises a pair of preferably triangular gussets 20 which are formed in first panel section 10. Each of the gussets 20 is cut from material of the related end panel 16 along a diagonal cut line 21 and is foldably joined along one edge on fold line 23 to the adjacent intermediate panel 14 of the same panel section and is foldably joined along another edge on fold line 25 to an adjacent end panel 18 of the second panel section.

Figure 2:
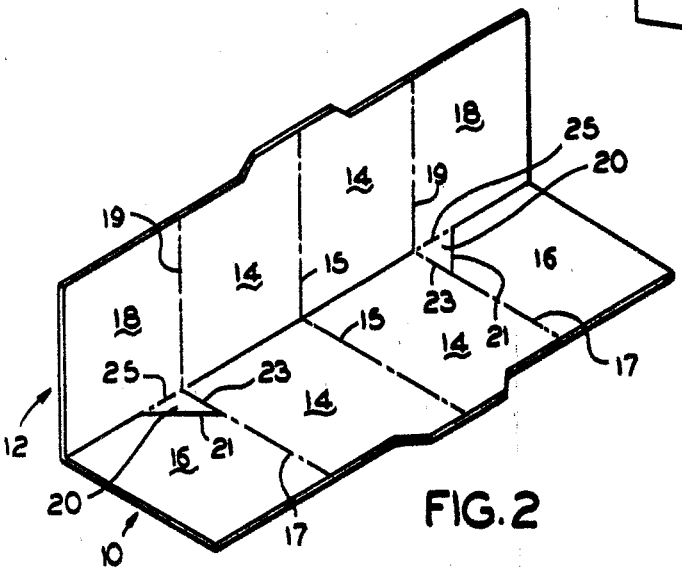
Figure 5:
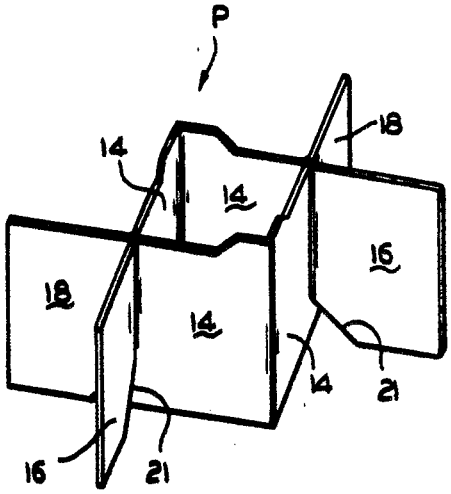
FIG. 5 is a perspective view of the partition in the completely erected position.
Figure 3:
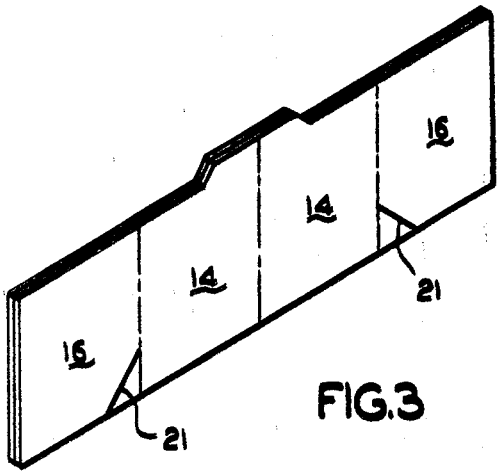

In erecting the partition, the panel sections are first folded in face-to-face relation, as illustrated in FIGS. 2 and 3. The end panels of the respective sections are then folded outwardly from each other and the partition is compressed in longitudinal direction to force the intermediate panels of one section away from the intermediate panels in the other section. The resulting configuration, as illustrated in FIG. 5, enables the partition to form, with the inside walls of the outer container or wrapper, seven individual cells. The central cell is quadrilateral in shape and is flanked on each end with a cluster of three cells.

Thus, it will be appreciated that the invention provides a novel and relatively inexpensive means of providing a multi-cell arrangement utilizing a one-piece blank but still affording substantial compressive strength for the package for which it is employed.

I claim:

1. An internal partition, formed of a unitary blank of foldable paperboard, for providing a multi-cell arrangement within a package, comprising:

(a) a pair of first and second panel sections of substantially similar overall dimensions and each including four partition panels;

(b) each of said panel sections including a pair of intermediate panels foldably joined to each other on a common fold line but being free from attachment to the intermediate panels of the other panel section;

(c) each of said panel sections including a pair of end panels foldably joined along their inboard edges to respective outboard edges of adjacent intermediate panels along second fold lines extending parallel to said common fold line but being free from direct attachment to related end panels of the other panel section;

(d) a pair of generally triangular gussets, each being formed of material cut from a respective end panel of said first panel section;

(e) each of said gussets being foldably joined along one edge to an adjacent intermediate panel of said first panel section and being foldably joined along another edge to an adjacent end panel of said second panel section;

(f) said gussets forming the sole means of connection between the respective panel sections to permit the panels to be folded into various planes, all of which are normal to a common plane, to form a plurality of cells separated from each other.

2. A partition according to claim 1, wherein said partition when folded into position forms with surrounding walls of an outer package a central cell which is four-sided and which is flanked on either end by a cluster of three-sided cells.

* * * * *